350-357 SR
XR 3,986,771
TX3092W

United States

Tsukada

[11] 3,986,771

[45] Oct. 19, 1976

[54] LIGHT IMAGE STORING AND REPRODUCING DEVICE

[75] Inventor: Syusei Tsukada, Tokyo, Japan

[73] Assignee: Canon Kabushiki Kaisha, Tokyo, Japan

[22] Filed: Dec. 31, 1974

[21] Appl. No.: 537,781

[30] Foreign Application Priority Data

Jan. 12, 1974 Japan ..... 49-6923

[52] U.S. Cl. ..... 355/3 R; 350/160 R; 355/4; 355/5; 355/11

[51] Int. Cl.[2] ..... G03G 15/00

[58] Field of Search ..... 355/5, 3 P, 3 R, 4, 355/16, 17, 71, 8, 11; 96/1 E; 204/2, 18 PC; 250/213 R; 340/173 CH; 353/31, 84; 350/160 R

[56] References Cited

UNITED STATES PATENTS

| | | | |
|---|---|---|---|
| 3,439,174 | 4/1969 | Snaper | 250/213 R |
| 3,451,741 | 6/1969 | Manos | 350/160 R |
| 3,521,941 | 7/1970 | Deb et al. | 350/160 R |
| 3,589,896 | 6/1971 | Wilcox | 350/160 R X |
| 3,692,659 | 9/1972 | Lees et al. | 204/2 X |
| 3,756,718 | 9/1973 | Letzer | 355/4 X |
| 3,764,211 | 10/1973 | Morse et al. | 355/71 |

*Primary Examiner*—Joseph W. Hartary
*Attorney, Agent, or Firm*—Fitzpatrick, Cella, Harper & Scinto

[57] ABSTRACT

A light image storing and reproducing device for storage and reproduction of original images comprises an information storage medium including a member having a photoconductive substance and an electrochromic substance, said member being supported between electrodes, original image projecting means for projecting an original image on said information storage medium, illuminating means for illuminating the surface of said information storage medium, and voltage applying means for applying a voltage of a prescribed polarity and a voltage of a reverse polarity interchangeably between the electrodes of the information storage medium.

9 Claims, 12 Drawing Figures

3986771
OR IN 355/3R

LIGHT IMAGE STORING AND REPRODUCING DEVICE

BACKGROUND OF THE INVENTION

1. Field of the Invention

This invention relates to an original image storing and reproducing device. More particularly, the invention relates to a light image storing and reproducing device in which an image stored in an information storage medium capable of storing and erasing information repeatedly is reversed or synthesized in the reproducible state.

2. Description of the Prior Art

The information storage medium to be used in this invention comprises an electrochromic material. When an electric current is passed through an electrochromic material, the light absorbing characteristics of the material are changed and as a result a color is developed or the original color is changed. This state can be retained for a long time even after application of the electric current is stopped, and when an electric current of a polarity reverse to that of the primarily applied current is applied to the electrochromic material in such color-developed or color-changed state, the developed color disappears or the color is changed to the original color. This reversible color change depending on the electric polarity is called "electrochromic phenomenon" and a material having such property is called "electrochromic material." In this electrochromic phenomenon, the degree of color development or color change is increased in proportion to the quantity of electricity applied as far as it does not reach a saturation value.

The mechanism causing this electrochromic phenomenon is not simple, but is is construed that in many cases, the electrochromic phenomenon is due to the so-called reduction-oxidation reaction between an electrolyte and a color-developing substance. In this case, the electrolyte and the color-developing substance cannot always be distinguished in the material, and the same substance can be both a color-developing material and an electrolyte in some case. If seen from a different viewpoint, it can be considered that the electrochromic phenomenon is due to the change in light absorbing characteristics caused by injection of electrons into the center of color. It is believed that in effect the electrochromic phenomenon will be caused by combination of these mechanisms.

Since the electrochromic phenomenon is a phenomenon changing electrically the inherent color of a material, a variety of combinations of colors can be considered. Further, whether an electrochromic material permeats light therethrough or reflects or diffuses light does not depend on properties of the electrochromic material per se but it is determined by the method of molding the electrochromic material into an information storage member. Accordingly, when an electrochromic material is used as an indication element, it can be molded into an element of either the transmission type or the reflection type.

In addition to the foregoing structural characteristics and variety, the electrochromic material has a memory property that the developed color can be retained until it is erased by application of electricity of a reverse polarity, and some electrichromic material has such a specific property that the developed color is changed depending on the value of the applied voltage. Because of such variety of characteristics, research works have recently been made extensively on application of electrochromic materials.

A great number of organic and inorganic materials are known to exhibit an electrochromic phenomenon, and all of these materials can be used in this invention. These known electrochromic materials are disclosed in, for example, the specification of British Pat. No. 1,186,541.

SUMMARY OF THE INVENTION

According to the present invention, there is provided a light image storing and reproducing device for storage and production of original images comprising an information storage medium including a member having a photoconductive substance and an electrochromic substance, said member being supported between electrodes, original image projecting means for projecting an original image on said information storage medium, illuminating means for illuminating the surface of said information storage medium and voltage applying means for applying a voltage of a prescribed polarity and a voltage of reverse polarity interchangeably between the electrodes of the information storage medium.

According to another aspect of the present invention there is provided a light image storing and reproducing device for storage and reproduction of original images comprising a plurality of information storage media, each information storage medium including a member having a photoconductive substance and an electrochromic substance and being supported between electrodes original image projecting means for projecting an original image on said information storage media, illuminating means for illuminating the surfaces of said information storage media, and a plurality of voltage applying means for applying a voltage of a prescribed polarity and a voltage of a reverse polarity between the electrodes of respective information storage media interchangeably.

According to a further aspect of the present invention, there is provided a light image storing and reproducing device comprising an information storage medium including a member having a photoconductive substance and an electrochromic substance, said member being supported between electrodes, a photosensitive material, original image supporting means, original image projecting optical means including optical passage for projecting an original image on said information storage medium and said photosensitive material, respectively, reproduced image projecting optical means for projecting an image reproduced on said information storage medium on said photosensitive material, color separating means disposed on optical passages of said original image projecting means, illuminating means for illuminating said information storage medium, and voltage applying means capable of applying a voltage of a prescribed polarity and a voltage of a reverse polarity interchangeably between the electrodes of said information storage medium.

This invention utilizes an information storage or memorizing medium comprising an electrochromic material for storing and reproducing original images and performing treatment of modifying or compiling original images.

It is a primary object of this invention to provide a light image storing and reproducing device of a simple structure in which either a negative image or a positive image can optionally be obtained from an original image.

Another object of this invention is to provide a light image storing and reproducing device of a simple structure in which an original image can freely be modified or compiled by erasing a part of the original image or adding a new image to the original.

Still another object of this invention is to provide a light image storing and reproducing device of a simple structure which can reproduce the color of an original image faithfully.

Other objects and features of this invention will be apparent from the detailed description given hereinafter.

DESCRIPTION OF THE PREFERRED EMBODIMENTS

Embodiments of this invention will now be described in detail by reference to accompanying drawings.

Figure 1:
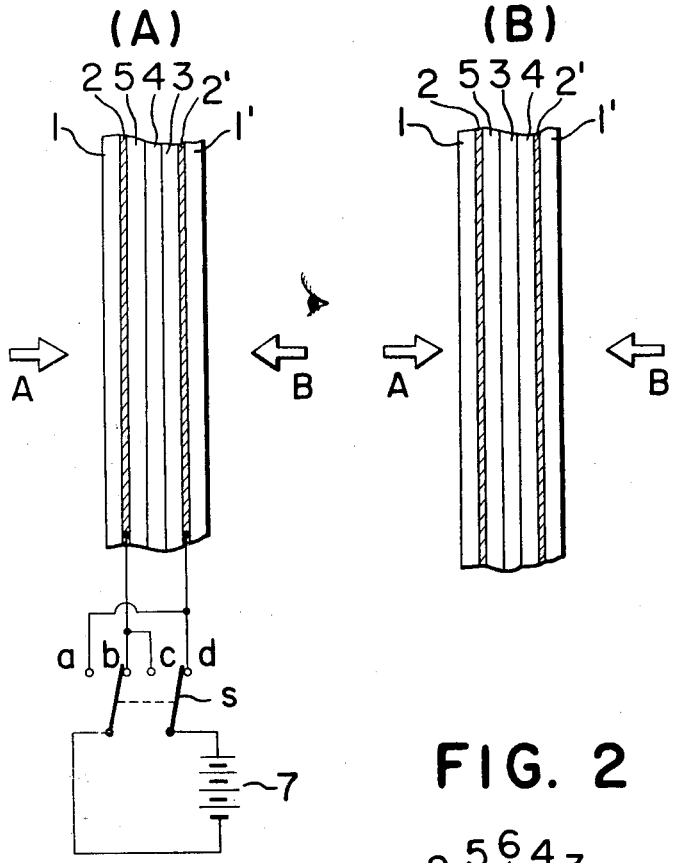
FIG. 1(A) and FIG. 1(B) are views illustrating the information storage medium to be used in this invention.

In FIG. 1(A), 1 and 1′ denote supports, which can be omitted if desired. Supports 1 and 1′ are composed of a transparent sheet or film of glass or polyester. Electrodes 2 and 2′ are disposed with a suitable spacing therebetween. Each of electrodes 2 and 2′ are composed of a transparent conductive material such as $SnO_2$ and $In_2O_3$. Such material is laminated on the support by vacuum evaporation deposition or chemical vapor deposition. Numeral 3 denotes an electrochromic material-containing color-developing layer which is formed by vacuum evaporation deposition of a transparent material such as $Wo_3$, $MoO_3$ and $TiO_2$. Numeral 4 denotes an electrolyte layer which is necessary for restoring the color of the color-developing layer 3 to the original color after color development in the layer 3. As the electrolyte, there can be used various material, for example, $CaF_2$, $ZrO_2$, $Ta_2O_5$, $TiO_2$ and $\beta$-$Al_2O_3$. Such electrolyte is formed into a transparent layer by vacuum evaporation deposition. A photosemiconductor layer 5 is made of a transparent material such as CdS, ZnO, Se, ZnS and OPC. The photoconductor layer 5 may be produced by chemical vapor deposition, spattering, ordinary vacuum evaporation deposition or coating. The information memorizing or storage medium P is a transparent plane sheet as a whole, and the entire laminate assembly of the electrodes 2 and 2′, the color-developing layer 3, the electrolyte layer 4 and the photosemiconductor 5 takes a form of a film having a thickness of 0.075 to 3 mm. An electric source 7 applies an electric voltage of 1 to about 100 V between the electrodes 2 and 2′, and the polarity can be changed by a double pole switch S. When this switch S is put in to connect contacts *a* and *c* with the electric source 7 so that the electrode 2′ near the color-developing layer 3 has a negative polarity, an electric current is applied so that color development is caused in the information memorizing medium P. When the switch is changed over to connect contacts *b* and *d* with the electric source 7, an electric current is applied so that the original color of the color memorizing medium P is restored.

In FIG. 1(A), when a light pattern A of about 200 luxes is projected to the photosemiconductor from the side of the support 1, the resistance of the photosemiconductor layer 5 is reduced at irradiated areas. If the switch S is changed over to connect contacts *a* and *c* with the electric source 7 and thereby to flow current between electrodes 2 and 2′ simultaneously with the irradiation, color development is caused in the color-developing layer in several seconds to about 100 seconds to form a pattern of the developed color corresponding to the light pattern. This color-developed state can be retained even if projection of the light pattern is stopped. If the electric source 7 is put off after completion of the color development and the entire face of the information storage medium 7 is irradiated from the side of the opposite support 1′, an operator B can view the color-developed pattern because of transmissive rays through the non-color-developed areas. In this case, if the spectral sensitivity of the photosemiconductive layer is made to differ from the spectral characteristic of a viewing light source or a filter is employed, real time observation is made possible. Erasion of this color-developed pattern is accomplished by irradiating uniformly the entire face of the photosemiconductor layer 5 from the side of the support 1 and simultaneously changing over the switch S to connect the contacts *b* and *d* with the electric source 7, whereby the original transparent state is restored in the color-developing layer 3. This procedure of recording and erasion of light patterns can be performed repeatedly.

FIG. 1(B) illustrates another instance of the information storage or memorizing medium which differs from the medium shown in FIG. 1(A) in the order of lamination of the color-developing layer 3 and the electrolyte layer 4. In FIG. 1(B), in order to cause color development in the color-developing layer 3, the laminate is connected to an electric source so that the electrode 2 has a negative polarity in contrast to the instance shown in FIG. 1(A).

Each of the information storage media shown in FIG. 1(A) and 1(B) is transparent as a whole. If one of electrodes of the information storage medium P, i.e., the photosemiconductive layer 5 or the electrolyte layer 4 is made opaque, the color-developed pattern can be viewed according to the reflection type method. In this reflection type method, the photosemiconductive layer 5 or electrolyte layer 4 is made opaque by adding a binder to the foregoing material (a sensitizing material is further incorporated in the case of the photosemiconductive layer). In this case, if the entire face of the information memorizing medium P is irradiated from the side of the support 1′ after the color development, an operator B can read the developed color pattern in a real time from the side of the support 1′.

Figure 2:
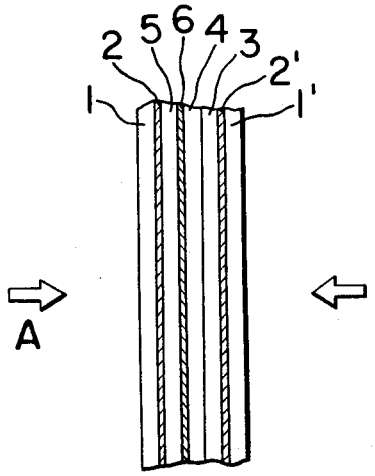
FIG. 2 is a view illustrating an information storage medium of the reflection type.

Another instance of the information storage medium of the reflection type is shown in FIG. 2, and this storage medium differs from the information storage medium shown in FIG. 1(A) in the point that an electroconductive light-shielding layer 6 is disposed between the photosemiconductor layer 5 and the electrolyte layer 4.

For formation of this light-shielding layer, there are employed, for example, $Al_2O_3$ and $CaMoO_4$, and a material having light-reflecting, light-absorbing or light-scattering properties is chosen. This light-shielding layer 6 may be disposed between the photosemiconductive layer 5 and the color-developing layer 3 in the information storage medium shown in FIG. 1(B). Further, it is possible to combine a photosemiconductor with an electrolyte to form one layer.

Figure 3:
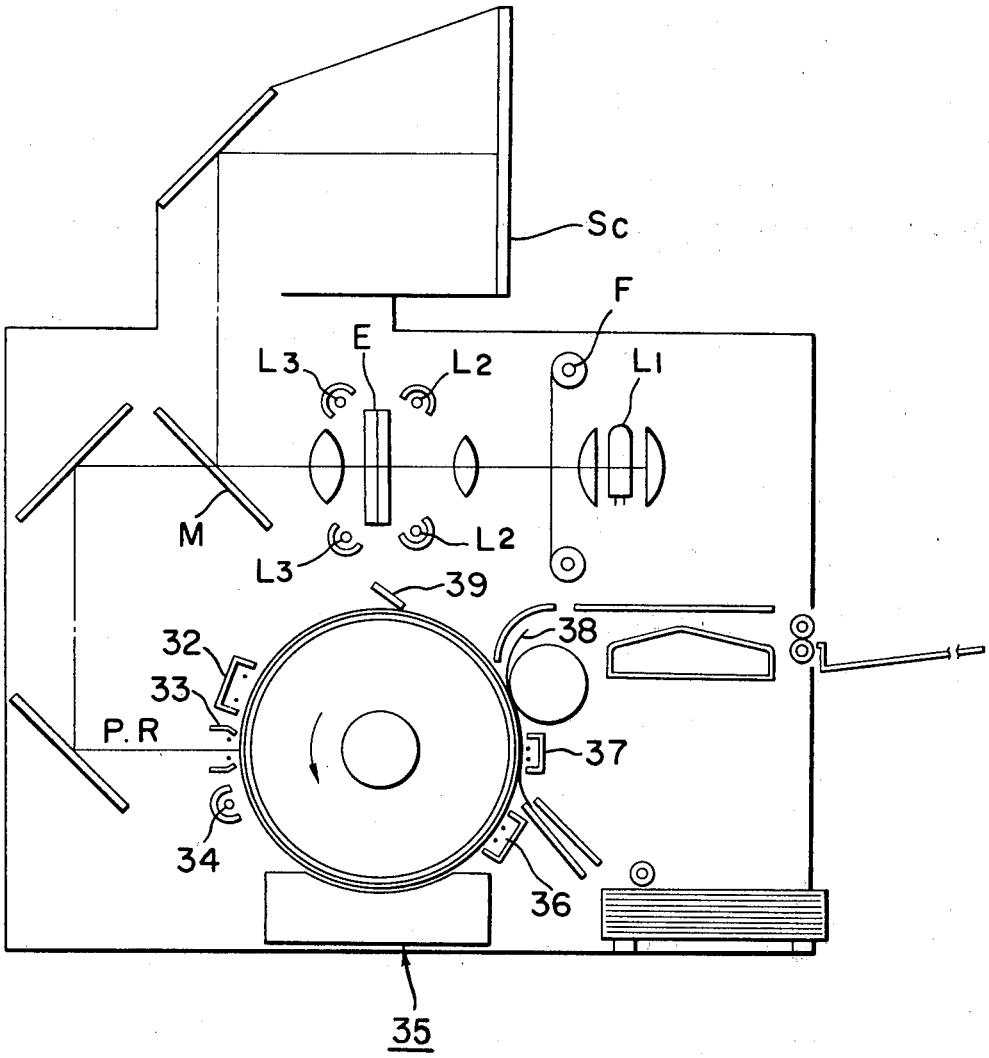
FIG. 3 is a view illustrating one embodiment of the device of this invention.

An embodiment of the device of this invention shown in FIG. 3 relates to a reader printer in which an image memorized in the information storage medium is converted to a negative or positive image for viewing and copies are obtained therefrom.

Referring to FIG. 3, an original film F is exposed to light from a light source lamp $L_1$ and the image of the original film F is focussed and recorded on an information storage or memorizing medium E having a structure and function as mentioned above. The original image is projected on a reader screen SC by means of a half mirror or rotary mirror M. The image is focussed on the screen and the image of the original is viewed and confirmed if desired. Electricity is appropriately applied to the storage medium in the image-focussed state to cause color development at irradiated areas. By the foregoing procedures, the image pattern of the original film is memorized on the storage medium. A light source $L_2$ is provided for projecting the pattern memorized on the storage medium onto a photosensitive material. When the information storage medium is irradiated by this light source $L_2$, the color-developed areas inhibit permeation of light and non-irradiated areas allow transmittance of light of the light source $L_2$.

In this embodiment, bright areas of the original are converted to dark areas. However, as is apparent from the above mentioned characteristics of the information memorizing or storage medium, it is possible to have bright areas of the original memorized as bright areas by the information memorizing medium.

If the so recorded pattern is irradiated by a light source pattern $L_3$, the radiating light is reflected at color-developed areas of the storage medium but is allowed to pass through non-developed areas, positive-positive reproduction can be accomplished to reproduce bright areas of the original as bright areas. Accordingly, the image memorized on the storage medium can be reproduced in the form of a negative image or positive image according to need. Especially in the case of the structure utilizing the change-over of the switch for reproduction, a positive image or a negative image can freely be selected and hence, this structure can be effectively utilized for copying reproduction described below. In short, desired numbers of copies carrying a positive image and copies carrying a negative image can optionally be obtained in copying reproduction. The copy-forming mechanism will now be described by reference to the device shown in FIG. 3.

The copy-forming mechanism is for reading out in the form of a light image the image memorized on the information storage medium, projecting this light image on a drum-like photosensitive material, developing the image according to the electrophotographic process and forming a reproduced image on a copy sheet. The photosensitive material shown in FIG. 3 comprises as indispensable elements an electroconductive substrate, photoconductive layer and an insulating layer, which are formed on a drum 31. A primary charge is applied to the surface of the photosensitive material by a primary charger 32, and AC electricity removal or application of a reverse polarity charge is effected by a discharger 33 capable of applying AC or voltage of a polarity reverse to that of the primary charge. Simultaneously, the above light image is projected. The entire face of the photosensitive material is exposed to light by means of an entire face exposure lamp 34. Thus, an electrostatic latent image corresponding to the light image is formed. The latent image is developed by a developer 35 and subjected to post charging by a corona discharger 36. Then, a transfer sheet 38 is introduced onto the drum and an electric field for transfer is given from the back by means of a transfer corona discharger 37, whereby the developed image is transferred on the transfer sheet. The transfer sheet 38 is used as a hard copy at the fixing step. The toner left on the drum after the transfer is cleaned away by a cleaning blade 39. Then, the above cycle of operation is repeated.

In the embodiment shown in FIG. 3, the information memorizing or storage medium E and reader screen SC are disposed separately. It is possible to dispose them integrally with each other. In this case, the information storage medium is fixed or piled integrally on a reader screen of a reader printer of the conventional type, and intended effects can be obtained by providing as additional means a light source for reding out a memorized image on the screen in this integrated assembly. Accordingly, negative or positive images can easily be prepared by a very simple structure.

Figure 4:
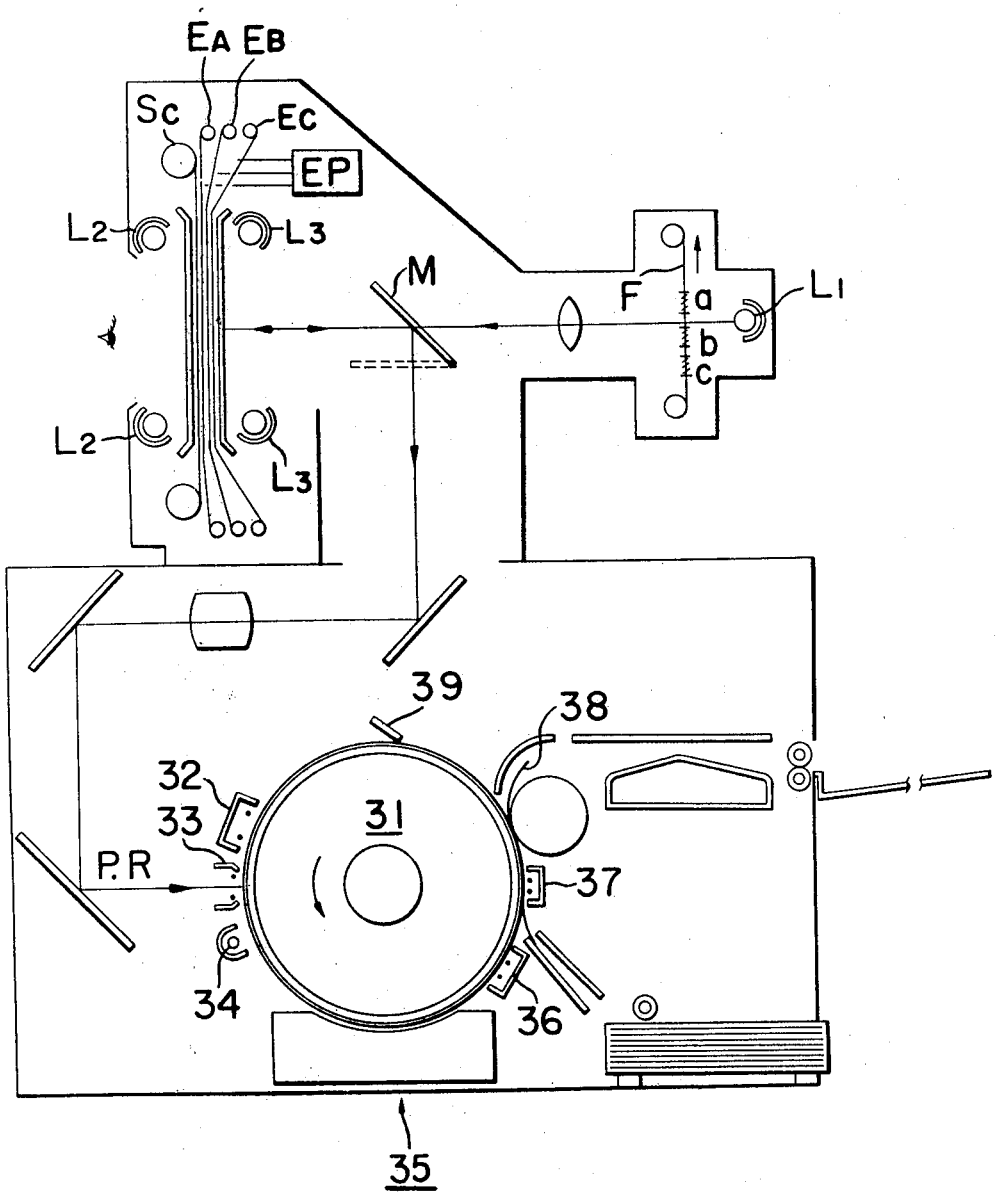
FIG. 4 is a view illustrating another embodiment of the device of this invention.

FIG. 4 illustrate still another embodiment of the device of this invention in which a plurality of information storage media are disposed and not only projection and storage of a single image but also projection and storage of a plurality of images can be accomplished.

Referring to FIG. 4, a plurality of information memorizing media $E_A$, $E_B$ and $E_C$ are disposed adjacent the screen SC on which the original image is projected, and change-over light sources $L_2$ and $L_3$ are disposed on both the sides of the assembly. Each information memorizing medium has a filmy form and is movably supported, and the screen SC is so arranged that a diffusion face, a transmission face or a light-absorbing face can optionally be exposed. An image memorized on each information storage medium is reproduced and copied according to a mechanism similar to that detailed by reference to FIG. 3.

Figure 5:
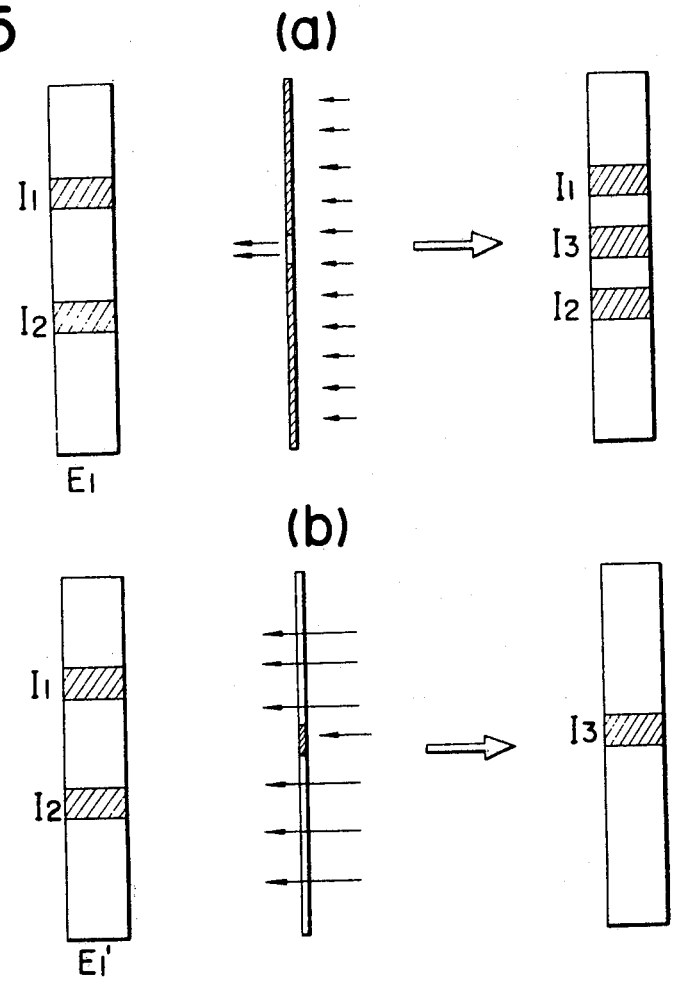
FIGS. 5 and 6 are view illustrating synthesis and compilation of images.

Memorization of a plurality of images on one information storage medium E will first be described. As shown in FIG. 5, a primary image is already recorded as color-developed images $I_1$ and $I_2$ on the storage medium, and another image D is projected on the memorized images. If the area $I_3$ of the projected image D is bright, memorized images $I_1$, $I_2$ and $I_3$ are formed on the storage medium. Accordingly, in the case of negative originals, piled memorization can easily be accomplished.

In contrast, if the newly projected image is a positive image, namely if the area $I_3$ is dark, already memorized images $I_1$ and $I_2$ are erased and only the image $I_3$ is memorized. In such case, a plurality of information storage media $E_A$, $E_B$ . . . can be used. By this arrangement, a second image and, if required, further images can be memorized and stored without erasion of the first image.

Figure 6:
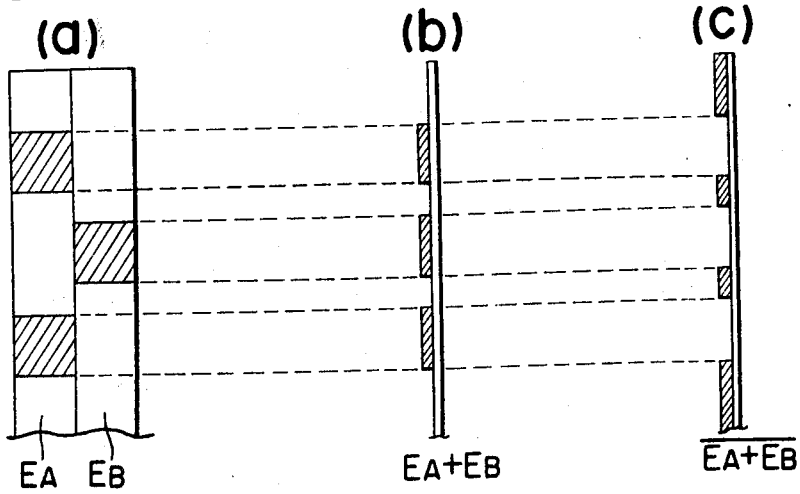

Each information storage or memorizing medium of the device shown in FIG. 4 is formed by laminating a transparent electrode on a very thin transparent film by vacuum evaporation deposition, and a transparent photosemiconductor layer and an electrochromic layer are disposed between two of such films. Each information storage medium is disposed movably independently. By this arrangement, it is made possible to synthesize easily images from images memorized on respective storage media, and a variety of synthetic masking operations are made possible in this structure by negative-positive change-over. FIG. 6 is given to illustrate this synthetic masking.

When color-developed images (areas indicated by oblique lines in the drawing) are stored on information memorizing media $E_A$ and $E_B$ as shown in FIG. 6(A), if these memorized images are positively reproduced, a pattern $E_A + E_B$ shown in FIG. 6(B) is formed. If the memorized images are reversely and negatively reproduced, a pattern $\overline{E_A + E_B}$ shown in FIG. 6(C) is obtained. Further, if the information storage medium $E_A$ or $E_B$ is moved, information of different arrangements can be obtained. Still further, one of images to be combined for synthesis can be used as a format of a prescribed pattern or an image-erasing masking mark. For attaining this image erasion, it is possible to provide a masking film of the sandwich type comprising an electrochromic layer supported between matrix electrodes.

A viewing screen of the device shown in FIG. 4 comprises a diffusion layer and it is movably disposed so that other screen is used at the copying operation. More specifically, when the memorized image is exposed to permeating light, a transparent screen is moved to the position of the viewing screen while the viewing screen is detached from this position, and a light source $L_2$ is enlightened. In contrast, when the memorized image is exposed to reflected light, a light-absorbing screen, for example, a black screen, is moved to the position of the viewing screen, and a light source $L_3$ is enlightened. Such transparent and black screens are connected to both the ends of the diffusion layer screen respectively, and they are hung on two shafts so that they can freely wound and reeled out.

Another embodiment of the device of this invention using the above-mentioned information storage medium will now be described by reference to FIG. 7. In the device shown in FIG. 7 color modification or correction of reproduced images and erasion of unnecessary color areas, especially black letter areas, can be accomplished very conveniently.

Figure 7:
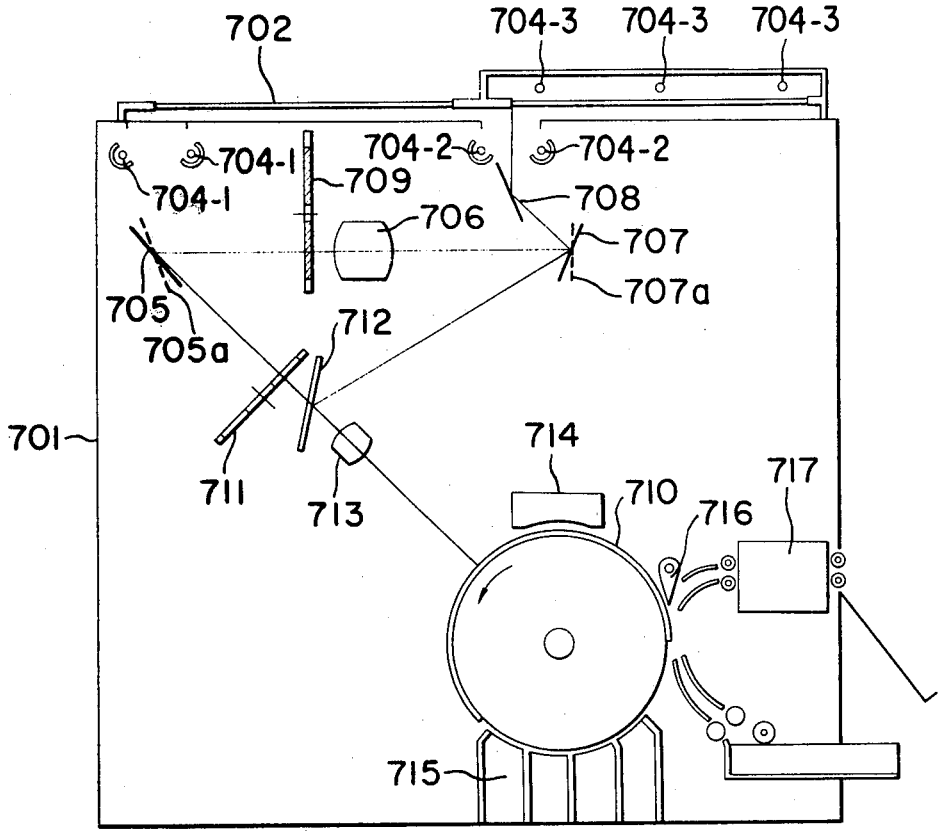
FIG. 7 is a view illustrating still another embodiment of this invention in which the color of a reproduced image can be corrected or an unnecessary color can be erased from a reproduced image.

Referring to FIG. 7, an original support 702 and an information memorizing or storage medium 703 are movably mounted on the upper portion of a machine case 701. The original support 702 is illuminated by, for example, a lamp 704-1, and an image of an original placed on the support 702 is projected on the information memorizing medium 703 through a mirror 705, a lens system 706 and mirrors 707 and 708.

Color separating means 709 including prescribed color separating filters is disposed on this optical passage for projection. In case a copy image is formed in the masked state, the mirrors 705 and 707 are shifted to positions indicated by dotted lines, and the original image and the stored image are projected on a photosensitive paper 710 held on the drum. The original image illuminated by illuminating means 704-1 is subjected to prescribed color separation or density adjustment through the deflected mirror 705 color separating means 711, and projected by a lens system 713. The image stored on the information memorizing medium 703 is irradiated by illuminating means 704-2 and projected on the photosensitive material 710 through mirror 708, deflected mirror 707, half mirror 712 and lens system 713. Illuminating means 704-3 is disposed to be used for performance of reverse projection. Prior to the above projection and exposure, the photosensitive material 710 is charged by charging means 714 so that a latent image can be formed thereon. The latent image formed by the above projection and exposure is developed by developing means 715 to form an image of prescribed color. In this manner, a required number of colors are developed, and the photosensitive paper 710 is separated from the drum by separating means 716 and, if desired, it is post-treated by fixing and drying means 717.

In the above illustrated embodiment, photosensitive materials of the Fax type are used. Of course, it is made possible to adopt a method including transferring a developed image formed on the photosensitive material onto a transfer paper and the like method, by, for example, changing the number of mirrors.

In the above device, it is possible to adopt a structure in which an optical system is moved instead of the above structure in which the original support and the information storage medium are moved.

Figure 8:
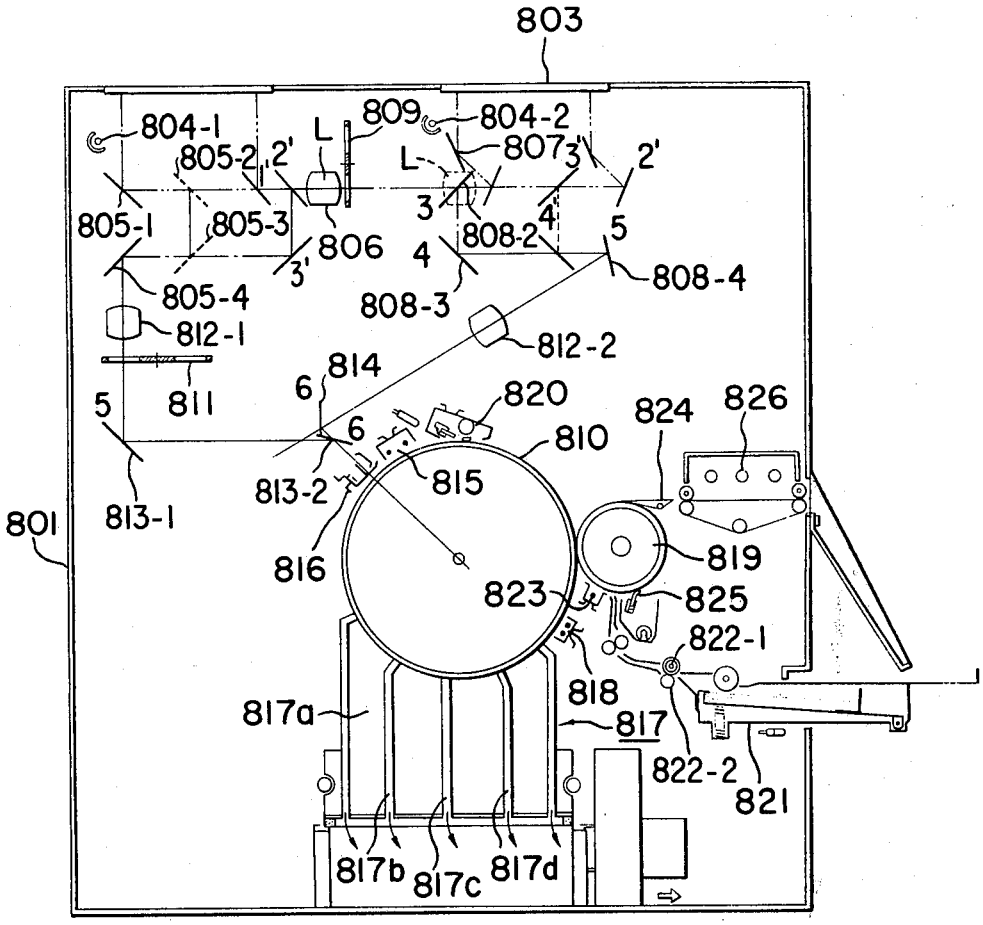
FIG. 8 is a view illustrating the color separating and correcting step which is conducted to obtain a desired color in the device shown in FIG. 7.

An instance of the device in which a moving optical system is used and images are piled and transferred on a transfer paper to effect color reproduction is illustrated in FIG. 8.

Referring to FIG. 8, an original support 802 and an information memorizing medium 803 are mounted on the upper portion of an outer casing 801 of the machine. Moving mirrors 805-1, 805-2 and 805-3 for scanning the original support 802 are disposed so that the mirrors 805-2 and 805-3 are integrally moved at a speed ½ time the speed of the mirror 805-1, and a light source 804-1 is disposed so that it is moved integrally with the mirror 805-1. Further, the scanning mirror 805-2 is movably mounted so that it deviates from the optical passage when the original image is projected on the information storage medium. Moving mirrors 807, 808-1, 808-2 and 808-3 for scanning the information storage medium are movably disposed so that mirrors 807 and 808-1 can move integrally and mirrors 808-2 and 808-3 can move integrally, and that the moving speed of the former pair is 2 times the moving speed of the latter pair of mirrors 808-2 and 808-3. Further, the mirror 802 is movably mounted so that it deviates from the optical passage when the original image is projected on the information storage medium. In order to visualize the image projected on the photosensitive material 801, charging means 815 and developing means 817 are disposed in the vicinity of the photosensitive material. The photosensitive material used in the device shown in the drawing comprises a photoconductive layer and an insulating layer on the surface. Simultaneously with the imagewise exposure, primary charging and reverse polarity charging or AC electricity removal are performed. For this purpose, an optically openable charger 816 is disposed. After development, the surface of the photosensitive material is post-charged by a post charger 818 and the developed image on the photosensitive material is transferred onto a transfer paper on a transfer drum 819. The transfer paper has been fed from a paper feed cassette 821 and electrostatically adsorbed on the transfer drum by a charger 823 or the like. After prescribed color transfer, the transfer sheet is separated from the transfer drum, fixed by a heating fixer 826 and discharged from the machine.

Figure 9:
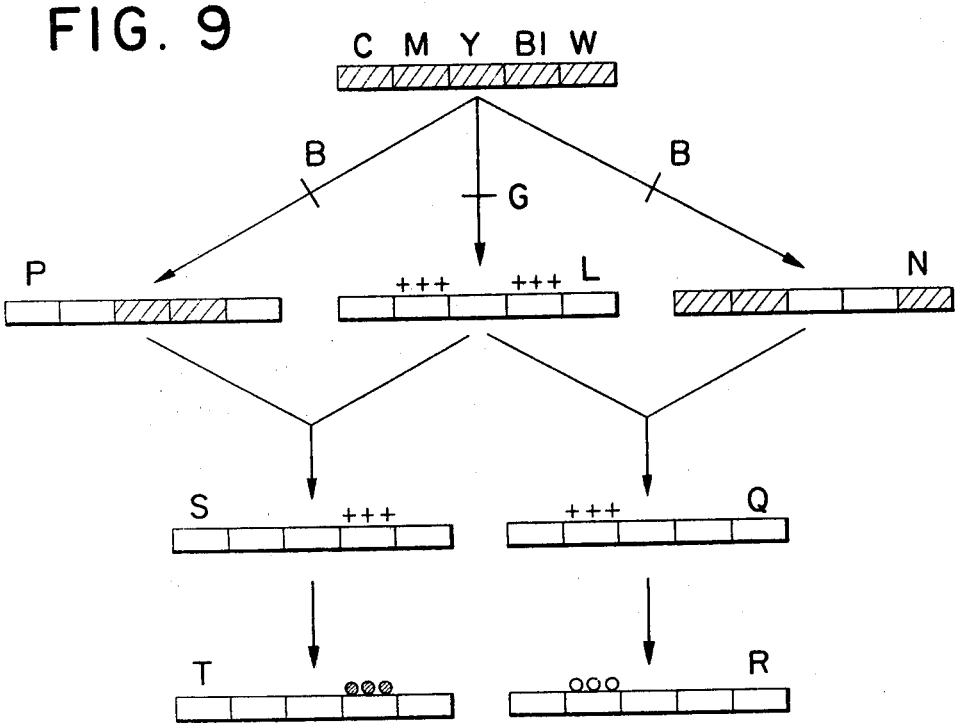
FIG. 9 is a view illustrating the masking process.

FIG. 9 illustrates process steps of color-separating an original image by a filter, exposing an electrophotographic sensitive material through the color-separated original image to form an electrostatical latent image thereon, re-projecting a negative or positive image of a pattern formed on an information storage medium by projection of the filter color-separated original image on the information storage medium, onto said electrostatically latent image and thus forming a copy in which black areas are erased or reproduced and other color areas are reproduced or erased.

The process steps for erasing black areas by using device shown in FIG. 7 will now be described by reference to FIG. 9.

Referring to FIG. 7, a multi-color original including black areas, for example, an original O having cyan, magenta, yellow, black and white areas, such as shown in FIG. 9, is placed on the original support 702, and the original is illuminated by an illuminating source 704-1 including a lamp and the like and is projected on an information memorizing medium 703 through mirror 705, first color separating filter 709 (blue), a lens 706 and mirrors 707 and 708. Simultaneously with or subsequently to this imagewise exposure, while photomemory is still present in a photosemiconductor of the information memorizing medium 703, a color-developing voltage is applied to the information storage medium 703 from an electric source (not shown) to form an image (N in FIG. 9) on the information memorizing medium 703. In the so formed image N, areas indicated by oblique lines are color-developed areas of a low reflectivity and black areas are non-developed areas of a high reflectivity, and this image corresponds to a negative image of the original.

Then, reflection mirrors 705 and 706 are shifted to positions 705*a* and 707*a* indicated by dotted lines to reproduce the original image on a photosensitive material 710. The photosensitive material 710 is charged in advance by a corona charger 714. As described above, the original image is illuminated by the illuminating source 704-1 and is projected on the photosensitive material 710 through reflection mirror 705, second color separating filter 711 (green) and lens 713. By this projection, of the original or imagewise exposure of the original, an electrostatic latent image L shown in FIG. 9 is formed on the photosensitive material 710. The above-mentioned image formed on the information memorizing medium 703 is also exposed simultaneously with the original image. Prior to this reproduction exposure, the previously applied voltage for projection of the original image on the information memorizing medium has already been released. The image reproduced by irradiation by the illuminating source 704-2 is projected on the photosensitive material 710, 703 through reflection mirrors 708 and 707, half mirror 712 and lens 713. By this exposure projection, the electrostatic latent image on the photosensitive material 710 is left only at a magenta area (Q in FIG. 9). This electrostatic latent image is developed with a magenta toner by a developer 715 to obtain a magenta image R in which black areas have been erased.

As is apparent from the foregoing illustration, other monochromatic images in which black areas have been erased can be obtained by selecting first and second color separating filters appropriately. Combinations of first and second color separating filters to be used for reproduction of monochromatic images are as shown in Table 1.

Table 1

| Monochromatic Image | First Color Separating Filter | Second Color Separating Filter |
|---|---|---|
| Yellow color image | Blue | Green or Red |
| Magenta color image | Green | Blue or Red |
| Cyan color image | Red | Blue or Green |

Process steps for obtaining a black image alone by erasing specific colors from an original image by using the device shown in FIG. 7 will now be described by reference to FIG. 9.

In the above-mentioned erasion of black areas, a negative image (N in FIG. 9) is formed on the information memorizing medium. In contrast, a positive image (P in FIG. 9) is formed on the information memorizing medium in this process.

More specifically, the entire surface of the information memorizing medium is uniformly color-developed prior to projection of the color separated image of the original, and then, while a voltage for erasing color-developed areas is applied from an electric source to the information memorizing medium, the color separated image of the original is exposed and projected on the information memorizing medium. As a result, erasion is accomplished only at irradiated areas and a positive image (P in FIG. 9) is formed.

When an electrophotographic sensitive material is exposed through the color separated image of the original and the positive image on the information memorizing medium, color areas are erased and an electrostatic latent image (S in FIG. 9) is formed only at black areas. When this electrostatic image is developed with a black toner, a black image (T in FIG. 9) in which color areas have been erased is obtained. Combinations of filters effective for erasing prescribed color images while reproducing black images are as shown in Table 2.

Table 2

| Color Image To Be Erased | First Color Separating Filter | Second Color Separating Filter |
|---|---|---|
| Yellow color image | Blue | Green or Red |
| Magenta color image | Green | Blue or Red |
| Cyan color image | Red | Blue or Green |

Process steps of obtaining a multi-color image by synthesizing color separated images, where masking is performed to correct differences of characteristics among colors formed at reproduction and development steps and a copy having a color image faithfully reproduced from an original image is obtained, will now be illustrated.

Figure 11:
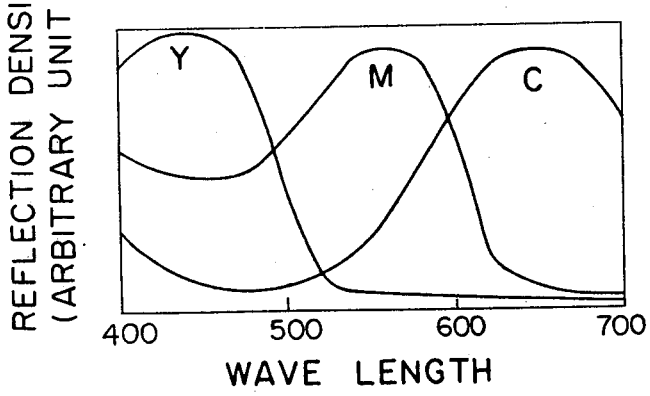
FIG. 11 is a view showing reflection characteristics of commercially available color developing toners.

When color reproduction is carried out according to the electrophotographic process reproducing characteristics are different in colors, and one cause of this undesired phenomenon is considered to be that developing characteristics are different among respective color developers, which will readily be understood from FIG. 11 which illustrates spectral reflection densities of instances of commercially available developers.

A magenta toner M absorbs a blue light and a cyan toner C absorbs a green light. Accordingly, a red color reproduced by the trichromatic separation method is a yellowish red color and a blue color reproduced by this method is a redish blue color. A masking process effective for overcoming this defect is shown in a sequence diagram of FIG. 10.

Figure 10:
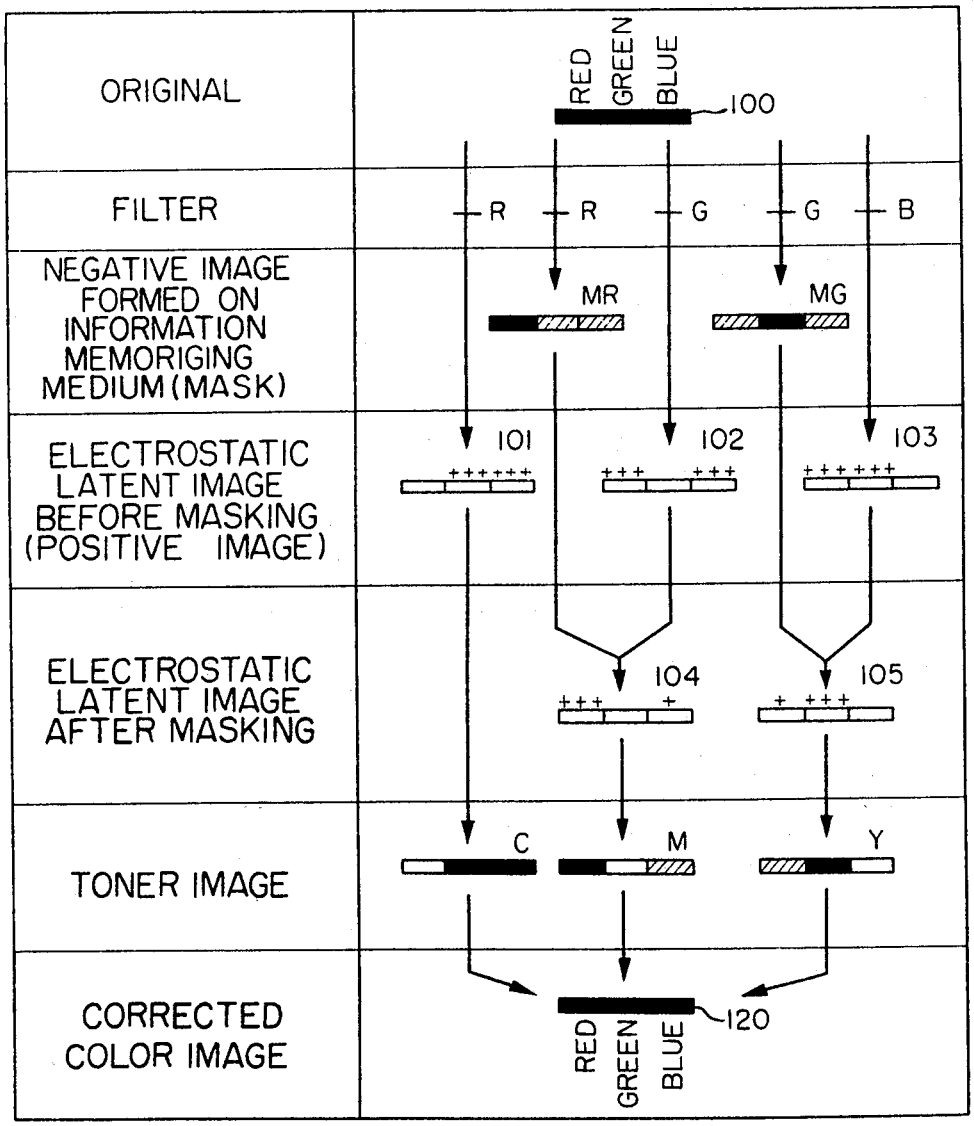
FIG. 10 is a sequence diagram illustrating the masking process utilized to obtain a multi-color copy.

Referring to FIG. 10, when a cyan image C is prepared, masking is not conducted and an electrophotographic sensitive material 100 is exposed imagewise through an original 100 via a red filter R to obtain an electrostatic latent image 101. This electrostatic latent image is developed with a cyan toner to obtain a cyan image C.

When a magenta image M is prepared, masking is conducted. More specifically, an information memorizing medium is exposed imagewise through the original via the red filter R to obtain a negative image MR. The black area on the negative image MR is an area in which the color is developed at a high density and the area indicated by oblique lines is an area in which the color is developed at a low density. Then, the electrophotographic material is exposed imagewise through the original 100 via a green filter to obtain an unmasked electrostatic latent image 102. The light image from the image MR on the information memorizing medium is piled on the unmasked electrostatic latent image 102, and in this state the light exposure is performed to obtain a masked electrostatic latent image 104. This latent image is developed with a magenta toner to obtain a color-corrected magenta image M.

When a yellow image Y is prepared, in the same manner as in the case of the magenta image M, a masked electrostatic latent image 105 is formed by employing a color-developed information memorizing medium MG and an unmasked electrostatic latent image 103. The so obtained latent image is developed with a yellow toner to obtain a color-corrected yellow image Y.

The so obtained three images are combined and synthesized to obtain a corrected image 120.

This process can be worked by using not only devices shown in FIGS. 7 and 8 but also other similar devices including some modifications or others.

For better illustration, this invention will now be described by reference to the following Example.

EXAMPLE

100 g of copper- and chlorine-sensitized CdS was dispersed in a solution of a vinyl chloride-vinyl acetate copolymer (formed by dissolving 20 g of Vinylite VMCH, trademark, in 20 g of methylethylketone and 30 g of methylisobutylketone), and the dispersion was coated on "Nesa" glass so that the dry thickness was 30 $\mu$.

The CdS layer-coated "Nesa" glass was sufficiently dried, and molybdenum oxide was vacuum-deposited in a thickness of 1 $\mu$ on the CdS layer. Then, silicon monoxide was vacuum-deposited in a thickness of 0.02 $\mu$ on the molybdenum oxide, and gold was vacuum-deposited in a thickness of 0.02 $\mu$ thereon to obtain an information storage medium. The "Nesa" glass face of the so obtained storage medium was exposed to light through an original including red and black letters via a red filter. The exposure quantity was 62 lux. sec. as measured with respect to the light coming from the white area of the original without using the filter.

During this light exposure, a voltage of 10 V was applied to the information storage medium while connecting the gold side to a positive pole and the "Nesa" side to a negative pole, to thereby form a blue image of a reflection density of 0.6 on the information storage medium. An NP photosensitive plate comprising an aluminum plate, a CdS-dispersed resin layer formed on the aluminum plate and a polyester film bonded to the resin layer was charged so that the surface potential was 1800 V. The light image from the original was projected on the photosensitive plate via a green filter and simultaneously, the light image from the information storage medium was projected on the photosensitive plate while performing AC electricity removal. In this case, the information storage medium was placed reversely. Namely, the gold electrode face was placed below. The exposure quantity at the white area was 54 lux. sec. as measured without using a filter. The so formed electrostatic latent image had a potential of − 70 V at the white area, a potential of − 10 V at the black area and a potential of + 250 V at the red area. The so obtained latent image was developed with a negatively charged red toner and the toner image was transferred onto a plane paper to obtain a red image. Then, the NP photosensitive plate was cleaned and positively charged, and exposed through the original via a red filter to obtain a latent image. The exposure quantity at this point was 38 lux. sec. on the white area without using a filter. The surface potential of the white area was − 50 V and the surface potential of the black area was + 380 V in this latent image. The latent image was developed with a black toner and the toner image was transferred onto the above red image-transferred paper to obtain a copy having images of red and black letters. The so obtained copy was excellent over a copy obtained according to a conventional process with respect to the image quality of either the red or black area. The image formed on the information storage medium was erased by applying a voltage of a polarity reverse to that of the previously applied voltage to the image-carrying information storage medium.

As is seen from the foregoing Example, according to this invention, an original image can easily be memorized and reproduced with use of a device of a simple structure and it can readily be reversed. Further, this invention can be effectively applied to original treatments in various types of printers and the device of this invention can also be used as an input source in other image treating systems. Thus, this invention can provide a device excellent in versatility.

In short, this invention can facilitate the color treatment of an original greatly and can be effectively applied to color-reproducing printers, and this invention makes great contributions in the art.

I claim:

1. A device for storing and reproducing light images of original images comprising:

a plurality of information storage mediums, each including a member having a photoconductive substance and an electrochromic substance and being supported between electrodes;

original image projecting means for projecting original images on said information storage mediums;

a plurality of voltage applying means for applying a voltage of one polarity and a voltage of a reverse polarity interchangeably across the electrodes of respective information storage mediums, wherein information images corresponding to projected original images are formed on said storage mediums when said one polarity is applied thereto, and said information images are stored thereon until erased by applying said reverse polarity thereto;

a photosensitive member; and means for forming a composite image on said photosensitive member, said image forming means including means for illuminating said mediums and means for projecting said stored images of said mediums in superimposed form on said photosensitive member.

2. A device for storing and reproducing light images as set forth in claim 1 in which said plurality of information storage mediums are arranged in parallel with each other.

3. A device for storing and reproducing light images as set forth in claim 1 further comprising viewing screen means disposed for viewing said images stored on said information storage mediums.

4. A device for storing and reproducing light images as set forth in claim 3 wherein said viewing screen means has a light-permeating face and a light-absorbing face, and is movably disposed with respect to the surfaces of said information storage mediums wherein the light-permeating and light-absorbing faces can be selectably shifted to a viewing position.

5. An apparatus for storing and reproducing light images of original images comprising:

an information storage medium including a member comprising a photoconductive substance and an electrochromic substance, said member being supported between a pair of electrodes;

a photosensitive member;

means for supporting an original;

projecting means having a first optical path for projecting an image of the original onto said information storage medium, a second optical path for projecting an image of the original onto said photosensitive member, and a third optical path for projecting an image from said information storage medium onto said photosenstive member;

means for separating color images of the original for projection along said optical paths; and means for reproducing images projected on said photosensitive member.

6. An apparatus for storing and reproducing light images as set forth in claim 5 wherein said projecting means includes a changeover mechanism disposed in a common portion of both said first and second optical paths and being positionable to complete said first and second paths selectively, whereby the original image is projected either onto the image storage medium or the photosensitive member.

7. An apparatus for storing and reproducing light images according to claim 5, wherein said photosensitive member is supported for movement during said projection of images thereon.

8. An apparatus for storing and reproducing light images according to claim 7, wherein said information storage medium is supported for movement in synchronism with said photosensitive member, and wherein said projection means includes means for scanning said information storage medium to project an image thereof onto said photosensitive member.

9. An apparatus for storing and reproducing light images according to claim 7, in which said projecting means includes movable scanning means disposed in said second and third optical paths for movement in synchronism with said photosensitive member.

* * * * *